United States Patent [19]

Stahlecker

[11] Patent Number: 4,559,773

[45] Date of Patent: Dec. 24, 1985

[54] METHOD AND APPARATUS FOR RESTARTING A YARN SPINNING APPARATUS

[76] Inventor: Peter H. Stahlecker, 7608 Antlers La., #4, Charlotte, N.C. 28210

[21] Appl. No.: 570,550

[22] Filed: Jan. 13, 1984

[30] Foreign Application Priority Data

Jan. 14, 1983 [DE] Fed. Rep. of Germany ..... 3301074

[51] Int. Cl.[4] ..... D01H 15/00; D01H 11/00

[52] U.S. Cl. ..... 57/261; 57/22; 57/306

[58] Field of Search ..... 57/22, 261, 262, 263, 57/306; 242/35.6 R

[56] References Cited

U.S. PATENT DOCUMENTS

| | | | |
|---|---|---|---|
| 3,858,385 | 1/1975 | Shinkai et al. | 57/263 |
| 4,083,171 | 4/1978 | Konig et al. | 57/263 |
| 4,170,101 | 10/1979 | Bock | 57/261 X |
| 4,389,837 | 6/1983 | Stahlecker et al. | 57/80 |
| 4,411,128 | 10/1983 | Mima | 57/261 X |
| 4,414,798 | 11/1983 | Matsui et al. | 57/261 X |

FOREIGN PATENT DOCUMENTS 2939644 9/1979 Fed. Rep. of Germany .

*Primary Examiner*—Stuart S. Levy
*Assistant Examiner*—Joseph J. Hail, III
*Attorney, Agent, or Firm*—Bell, Seltzer, Park & Gibson

[57] ABSTRACT

A method and apparatus is disclosed for restarting a yarn spinning apparatus, such as a wrap yarn spinning machine, and which involves the removal of an initial low quality interconnection in the form of a pieced-up segment, and its subsequent replacement with a high quality interconnection, without interrupting the yarn advance. For this purpose, the apparatus includes a first yarn accumulator for receiving the portion of the yarn which includes the pieced-up segment, and this portion is severed and removed. A second auxiliary yarn accumulator is also provided which is attached to a yarn splicing device, and which is operative to accumulate the advancing finished yarn during the brief time the splicing operation occurs. The brief accumulation time of the finished yarn in the auxiliary accumulator avoids the troublesome step of removing a large quantity of finished yarn from an accumulator.

12 Claims, 13 Drawing Figures

METHOD AND APPARATUS FOR RESTARTING A YARN SPINNING APPARATUS

Figure 1:
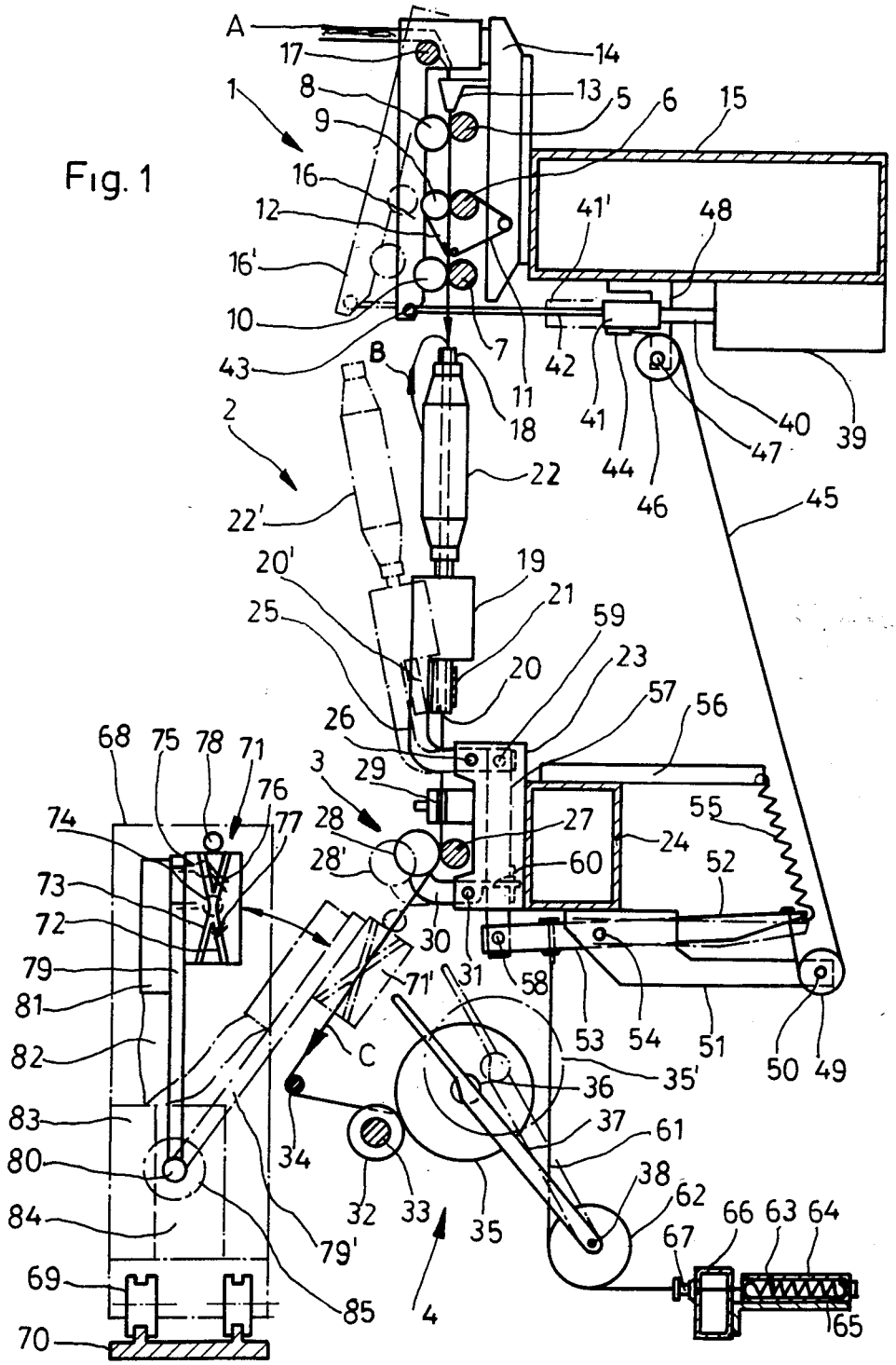

The present invention relates to a method and apparatus for restarting a yarn spinning machine, and which is characterized by the ability to be efficiently rethreaded and started after a yarn break, and with the resulting yarn having a high quality interconnection in the form of a splice or the like.

In many textile yarn spinning machines which involve the winding of the finished or processed yarn, normal piece-up following a yarn break results in the formation of a weak or enlarged pieced-up segment which can produce difficulties during subsequent yarn processing. In some of these operations, such as an open end spinning operation, or a wrap spinning operation, it is not possible as a practical matter to stop the machine after the advance of the yarn has been commenced to permit the unacceptable pieced-up segment to be cut out and replaced, since such stopping would adversely effect the yarn quality and uniformity. Thus in these cases, it is common to remove the unacceptable pieced-up segments by subsequently rewinding the yarn on a separate winder. The separate winder includes a sensor, and upon the sensor detecting a pieced-up segment, the rewinding operation is stopped and a manual or automatic pneumatic splicing device or the like is employed to cut out the pieced-up segment and form a high quality splice. As will be apparent, this separate rewinding operation is time consuming, and it requires additional equipment.

In an attempt to avoid the above rewinding operation, it has been proposed to effect the cut-out and replacement of an unacceptable pieced-up segment on the yarn processing machine itself, and while the yarn is being advanced. Specifically, there is described in patent DE-OS No. 29 39 644, a process for restarting a yarn spinning machine wherein an initially pieced-up yarn is fed to a suction extractor or accumulator, into which the yarn portion having the pieced-up segment is drawn in the form of a loop. Thereafter, both the yarn portion leading from the take-up package and the yarn portion leading from the spinning apparatus are cut at a distance from the accumulator, so that the yarn loop in the accumulator, and the pieced-up segment, are removed. Thereafter, the two yarn ends are fed to an auxiliary knot tying device, and the yarn that continues to be advanced from the spinning apparatus is fed to the same suction extractor by means of a yarn feed device. The two yarn ends introduced into the knot tying device are then knotted. As will be apparent, a relatively long time period is required for introducing the yarn ends and tying the yarn in the knot tying device, and as a result, a long length of the advancing yarn is received in the suction extractor. In cases where the spinning apparatus has a high production speed, as is the case for example with wrapped yarn spinning machines, a relatively large yarn loop is formed in the extractor, and a large loop can result in considerable difficulties, in that there is a risk that the two strands of the loop will tangle and become knotted. These knots may not come free during the subsequent take-up of the accumulated yarn onto the take-up package, and thus the wound yarn on the package may contain knots or entanglements that must later be removed in a separate winding process prior to further processing of the yarn.

It is accordingly an object of the present invention to provide a method and apparatus for restarting the winding of a yarn from a supply onto a take-up package under conditions wherein the advance of the yarn cannot as a practical matter be terminated, and wherein an initial unacceptable pieced-up segment in the yarn may be cut out and replaced with a higher quality interconnection while the advance is continued, thereby avoiding the need for any separate rewinding operation.

It is a further object of the present invention to provide a method and apparatus for restarting the winding of a yarn in a spinning operation, which is effective at very high production speeds, and which avoids the risk of the formation of knots or entanglements in the finished yarn during the restarting operation.

It is a more specific object of the present invention to provide a method and apparatus for restarting the winding of a yarn after a yarn break in a yarn spinning operation, which includes the use of a yarn interconnecting device, and wherein the thread-up of the interconnecting device is conducted without forming a yarn accumulation of finished yarn which must be subsequently withdrawn from an accummulator and wound on the take-up package, and further wherein the finished yarn is accummulated only during the relatively brief time which is required for the actual interconnection of the yarn ends which are threaded through the interconnecting device.

These and other objects and advantages of the present invention are achieved in the embodiment illustrated herein by the provision of a method and apparatus which involves the steps of terminating the supply of the fiber material to the spinning means, and the rotation of the take-up package, upon a yarn break being detected. The finished yarn end extending from the take-up package is then withdrawn and threaded through a yarn interconnecting means, which is preferably positioned in front of the winding station and immediately adjacent the normal path of travel of the yarn being processed. The withdrawn finished yarn end is returned to a location adjacent the yarn spinning means, and is then interconnected to the yarn fiber material by restarting the supply of the fiber material and so as to form a low quality pieced-up segment. Either prior to or after the above piecing-up step, the withdrawn finished yarn end is severed at a point between the yarn interconnecting means and the spinning means. The resulting newly spun yarn is advanced into a first yarn accumulator, while the take-up winding means remains inoperative, and so that the pieced-up segment is received in the accumulator. The newly spun yarn is then threaded through the yarn interconnecting means and so that the first yarn accumulator is positioned downstream of the yarn interconnecting means, with this threading step being carried out while continuing to advance the newly spun yarn and accumulate the same in the first yarn accumulator. The newly spun yarn and the originally withdrawn finished yarn are then momentarily held stationary in the yarn interconnecting means, and the interconnecting means is actuated to interconnect the yarn portions and form a high quality interconnection and a resulting finished yarn. The advance of the newly spun yarn is continued during the brief holding of the yarn portions, and the advancing newly spun yarn is accumulated in a second separate auxiliary yarn accumulator disposed upstream of the yarn interconnecting means. The yarn disposed in the first yarn accumulator, and which includes the low quality pieced-up segment, is severed from the finished yarn, and the finished yarn is withdrawn from the yarn interconnecting means by actuating the take-up winding means so that the finished yarn is wound upon the take-up package and the yarn is withdrawn from the auxiliary accumulator. Thus the low quality pieced-up segment is removed and replaced with a high quality yarn interconnection, without interruption of the advance of the yarn.

In the preferred embodiment of the present invention, the first yarn accumulator comprises a movable suction tube which has a length adapted to service a plurality of yarn spinning units on the machine. Also, the yarn interconnecting means is mounted on a carriage which is movable along the yarn spinning machine, and the interconnecting means is movably mounted with respect to the carriage so that it is selectively movable to an operative position closely adjacent the normal path of travel of the yarn at an associated yarn spinning unit. Further, the second separate accumulator preferably comprises a suction tube mounted on the carriage and having an open end mounted to the yarn interconnecting means.

Some of the objects of the invention having been stated, other objects and advantages will become apparent as the description proceeds, when taken in connection with the accompanying drawings, in which—

Figure 9:
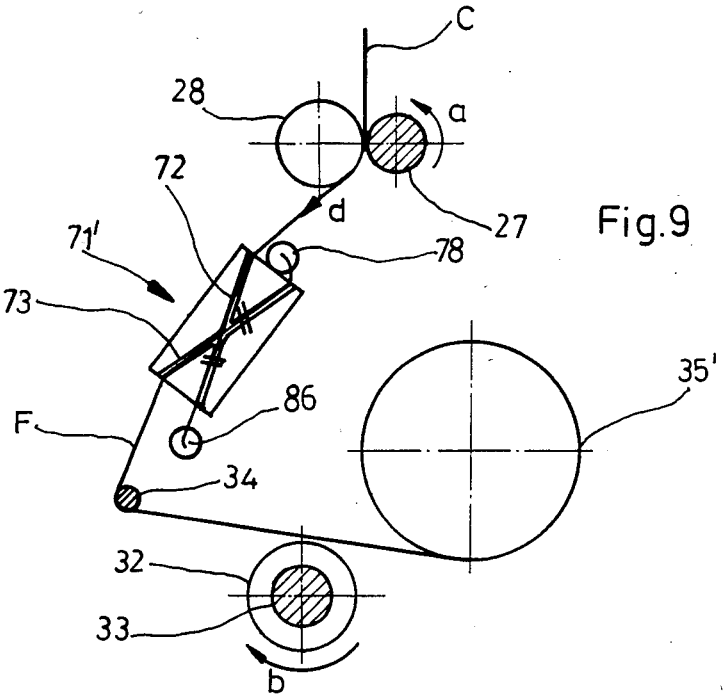
Figure 10:
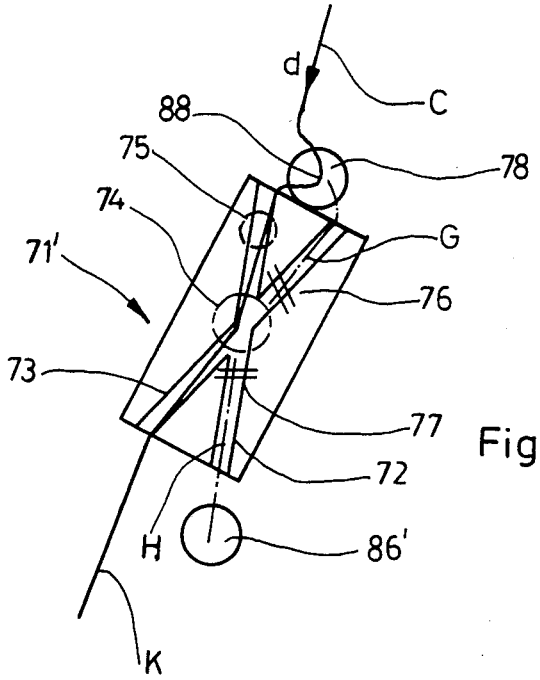
Figure 11:
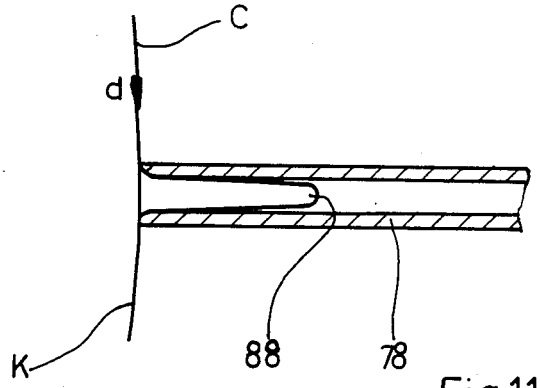
Figure 12:
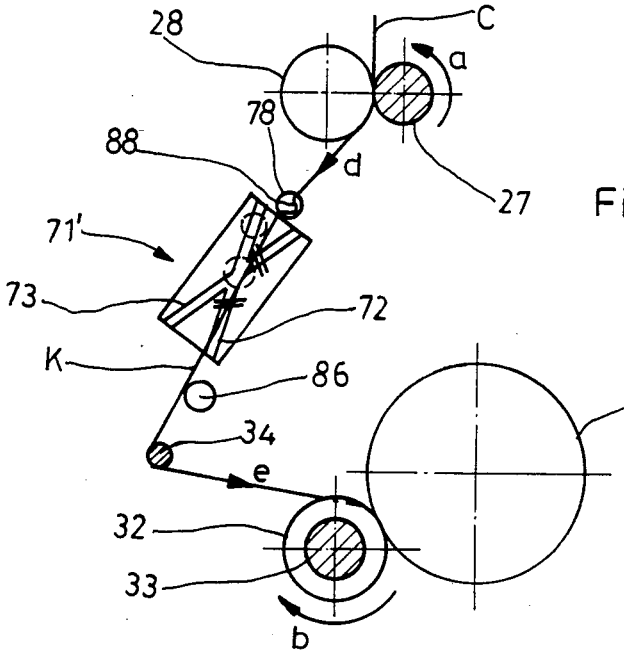

FIG. 1 is a schematic sectional side elevation view of one spinning unit of a wrapped yarn spinning apparatus and which embodies the features of the present invention;

FIGS. 2–10, 12, and 13 are fragmentary schematic views illustrating a portion of the yarn feed means and the yarn package take-up means, and indicating the sequential steps of the method of the present invention; and FIG. 11 is a fragmentary sectional view of the auxiliary accumulator with a yarn loop being formed therein.

Referring more particularly to the drawings, FIG. 1 illustrates one yarn spinning unit of a wrapped yarn spinning machine, and it will be understood that the machine will normally include a large number of such units disposed in a side by side arrangement along the length of the machine. At each unit, there is provided a yarn spinning apparatus which comprises a drafting system 1, a spindle assembly 2, yarn delivery roll means 3, and a takeup winder 4.

The drafting system 1 contains three bottom rolls 5, 6, and 7, which extend along the length of the machine and are driven from a motor drive section located at one end of the machine. Depending on the application, the number of these rolls may vary. Three cooperating top rolls 8, 9, and 10, are associated with respective ones of the bottom rolls, with the top rolls preferably extending only over one yarn spinning unit. The top rolls are rotatably mounted on a bracket 16 which is pivoted about a fixed shaft 17, and the bottom rolls are rotating mounted to a fixed bracket 14. The center pair of rolls 6 and 9 are equipped with respective narrow belts 11 and 12 for the drawing mechanism, and each successive pair of rolls rotates faster than the preceding pair. The core strand A, which may for example be composed of a sliver of staple fibers, is supplied to the first pair of rolls 5, 8, through a feed funnel 13.

The spindle assembly 2 is mounted downstream of the drafting system 1, and includes a hollow spindle 18 which is rotatably mounted in a bearing housing 19 and driven by a tangential belt 21 which extends along the length of the entire machine and is driven from the end of the machine. The hollow spindle 18 includes a whorl 20 which is contacted by the belt 21. A supply package 22 of the binder strand B is coaxially mounted on the spindle 18, and is non-rotatably joined to the spindle so that the package rotates with the spindle. The upstream end of the spindle 18 is designed as a twist inserter of known construction, and the strand B is introduced through the inserter and into the hollow spindle 18. The binder strand B is thereby spirally wound around the stretched and drawn sliver A producing a finished wrapped yarn C, which exits from the lower end of the hollow spindle 18.

The yarn delivery roll means 3 is mounted downstream of the spindle assembly 2, and comprises a pair of drawing rolls 27 and 28. The driven roll 27 is designed as a shaft extending along the longitudinal direction of the machine, while a pressure roll 28 is associated with the driven roll 27 at each yarn forming position. The pressure roll 28 is mounted on a pivot arm 30 which is pivotable about the pin 31. A yarn break detector 29 is mounted adjacent the delivery roll means 3, and monitors for the proper presence of the wrapped yarn C.

The take-up winder 4 is positioned downstream of the yarn delivery roll means 3, and includes a grooved roll 32 which serves to traverse the wrapped yarn C to form the take-up package 35. The grooved roll 32 is mounted on a shaft 33 which extends along the length of the entire machine, and is connected to a drive at the end of the machine. In the operating position, the grooved roll 32 is in contact with the package 35 on which the wrapped yarn C is wound. The package 35 includes a bobbin or tube 36 held in a bobbin support frame 37, which pivots on a fixed shaft 38 so that the package 35 may be selectively lifted from the grooved roll 32. Also, the package 35 may be spring biased toward the roll 32.

Upon the yarn break detector 29 detecting a break in one or both of the components A or B of the wrapped yarn C, the spinning operation is brought to a complete stop, without effecting the adjacent spinning units. For this purpose, the individual components are brought to the positions shown in dashed lines in FIG. 1, whereby the components have the same reference symbols with a prime being added.

The yarn break detector 29 is operatively connected to a pneumatic control system which includes a piston cylinder 39. The cylinder 39 is mounted to a hollow support 15 which forms a part of the frame of the machine and which extends in the longitudinal direction. The support 15 also mounts the components of the drafting system 1 as described above. A rod 40 is connected to the piston in the cylinder 39 and is equipped with a guide sleeve 41, which is connected via a spring plate 42 to the free end of the bracket 16. Thus in the event of a yarn break, the sleeve 41 is moved to the position 41', so that the bracket 16 is shifted to the position 16' as shown in dashed lines. This terminates any further advance of the sliver A through the drafting system 1.

A bracket 48 is mounted to the support 15, and rotatably mounts a guide roll 46 adjacent the rod 40 by means of the pin 47. A cable 45 has one of its ends attached to the sleeve 41 by means of the connector 44, and the cable 45 extends over the guide roll 46 and downwardly to another guide roll 49 which is rotatably mounted to the bracket 51 by means of the pin 50. The bracket 51 is fixedly mounted to the frame support member 24 which extends along the longitudinal direction of the machine, and a two arm lever 52, 53 is pivotally mounted to the bracket 51 at the pin 54. Also, the arm 52 of this lever maintains the cable 45 under tension by reason of the spring 55, which interconnects the end of the arm 52 with a fixed bracket 56. The other arm 53 of the lever is connected by means of the pin 58 to the intermediate lever 57, and the intermediate lever 57 is connected to the lower arm 25 of the bearing housing 19, and thus the whorl 20, by the pin 59. The lower arm 25 of the bearing housing 19 is pivotally mounted to the holder 23 by the pin 26, and the holder 23 is in turn fixedly attached to the frame support member 24. Since the pin 59 which interconnects the lever 57 and the lower arm 25 is on one side of the pin 26, it will be seen that upward movement of the lever 57 causes the housing 19 to pivot outwardly about the axis of pin 26 to the dashed line position.

The pressure roll 28 is rotatably mounted on the arm 30, which in turn is pivotally mounted to the fixed holder 23 by the pin 31. The lever 57 includes an abutment 60 which engages the opposite end of the arm 30, so that upward movement of the lever 57 also causes the roll 28 to move outwardly to the inoperative dashed line position.

Another cable 61 is connected to the arm 53, and is tensioned by a spring 63 which is connected to the machine frame in the manner further described below. The cable 61 is guided over a pulley 62, which is non-rotatably connected with the bobbin frame 37 which rotatably mounts the take-up package 35, and with the package 35 being arranged coaxially to the mounting shaft 38 of the pulley 62. The spring 63 is disposed in a holder 64, which is mounted on a bracket 65 on the machine frame member 66. The cable 61 is provided with a stop 67 which is arranged in such a manner that the cable 61 is loosely looped around the pulley 62 in the normal operating position. Thus the bobbin frame 37 is free to pivot about the axis of the shaft 38 as the package builds. When the arm 53 is lifted by the cable 45, the cable 61 is tensioned so that it will contact the pulley 62 under a frictional force and cause the pulley 62 to rotate and lift the package 35 from the drive roll 32.

The apparatus of the present invention further includes a carriage which is mounted for movement along at least one side of the apparatus and to a position immediately adjacent each of the yarn processing units. The carriage is indicated in dashed lines at 68 in FIG. 1, and is equipped with wheels 69 which run on the rails 70 which extend along the front of the machine. The carriage mounts a yarn interconnecting means 71, which preferably is in the form of a yarn splicing device, and which is movably mounted on the carriage between a rest or inoperative position as shown in solid lines, and an operative position disposed immediately adjacent the path of travel of the finished wrapped yarn C. The travel of the device 71 is limited in the area between the delivery roll means 3 and the take-up winder 4 by a guide rod 34, which is mounted to the machine and extends in the longitudinal direction along substantially its full length.

The interconnecting device 71 may be of a type well known in the art, it only being required that the device operate in a manner such that the advancing yarn may be threaded into it and stopped for a short period of time, i.e., for the period of time required for effecting the yarn interconnection, preferably by splicing. A splicer of this type is manufactured by Pentwyn Precision Limited of Great Britain. As illustrated, the splicer 71 has two intersecting slots 72 and 73, and a compressed air nozzle 74 disposed at the crossing point of the slots. The actual splicing operation is effected by the air nozzle 74, and the splicer also includes cutting devices 76 and 77, as well as a suction holding device 75 or a mechanical clamping device, all of which are shown schematically. Also mounted on the splicer 71 is an auxiliary suction yarn accumulator 78, which is arranged between the two insert slots 72 and 73, and on the side of the splicer adjacent the delivery roll means 3 when the device is moved to the operative position 71' adjacent the yarn path of travel. The operation of the auxiliary suction accumulator 78 will be explained below.

The splicer 71 is mounted on a pivotable lever arm 79, and which can pivot about the axle 80 on the carriage 69 by means of a servo-motor 85. The carriage 68 also mounts a vacuum source 83 and a source 84 of pressurized air. Suitable blowers (not shown) may be installed on the carriage 68 for these purposes. However, it is also possible to connect the carriage 68 by means of flexible hoses to a central vacuum system and pressurized air system which service the spinning machine, so that the carriage need not include its own separate vacuum source 83 and pressurized air source 84. In the illustrated embodiment, the vacuum source 83 and the pressurized air source 84 are connected to the splicer 71 by flexible supply hoses. The splicer 71 also has an electrical supply for controlling the cutting and clamping devices, which may be programmed for automatic sequential operation.

Figure 2:
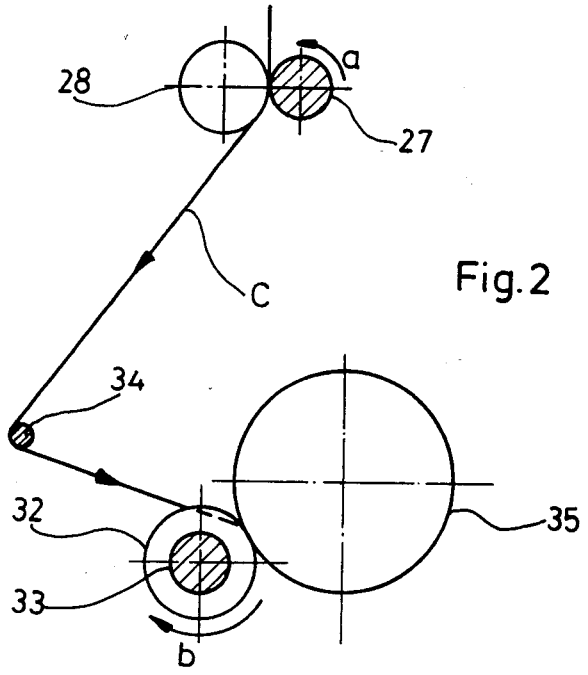

FIGS. 2–10 and 12–13 illustrate the portion of the yarn path of travel between the delivery roll means 3 and the take-up winder 4, and illustrate the sequential steps of the method of the present invention. In this regard, it will be understood that in the operative condition, the take-up speed of the shaft 33 and the grooved roll 32, which rotate in the direction of arrow b as seen in FIG. 2, is slightly greater than the delivery speed of the two delivery rolls 27 and 28, which are driven in the direction of arrow a, so that the wrapped yarn C is taken up on the take-up package 35 with a certain degree of tension.

Figure 3:
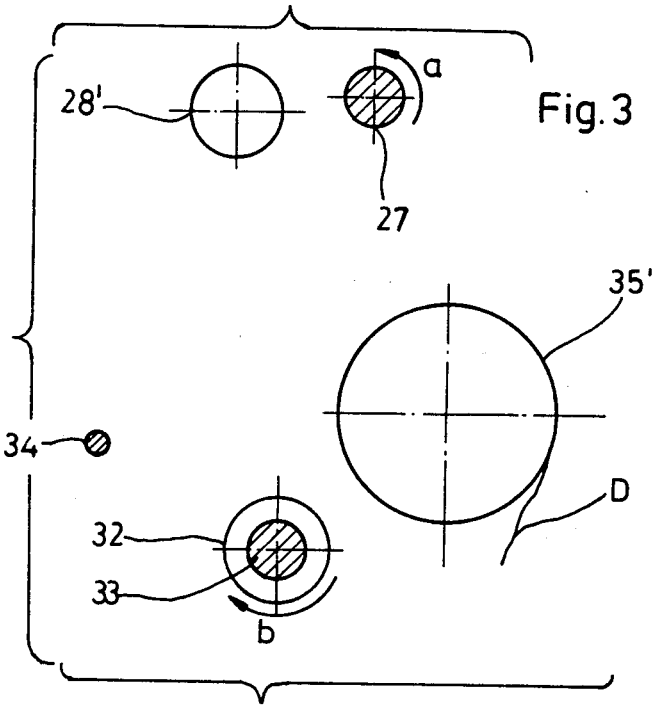

FIG. 3 illustrates the condition after a yarn break occurs and wherein the supply of the sliver A and the rotation of the take-up package has terminated. More particularly, the top rolls of the drafting system 1 are moved away from the bottom rolls, the pressure roll 28 is moved away from the roll 27 to the position 28', and the package 35 is lifted from the grooved roll 32 to the position 35'. The driven roll 27 and the shaft 33 continue to rotate without interruption, and the broken yarn end D is shown hanging for illustration purposes from the lifted package 35'.

Figure 4:
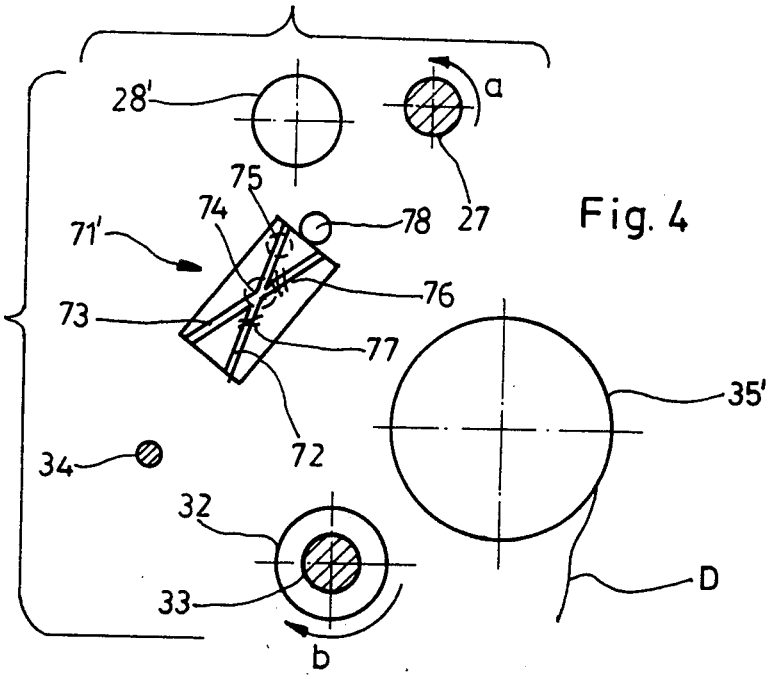
Figure 5:
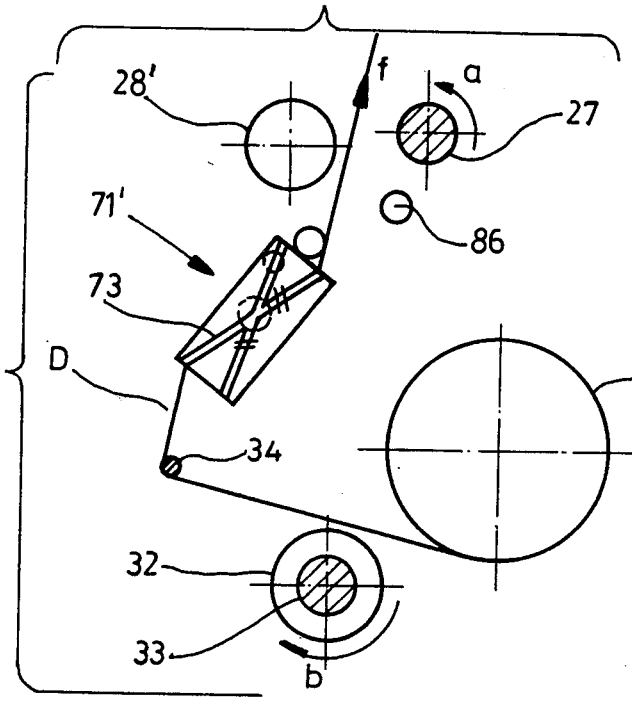

The carriage 68 is moved to the position of the spinning machine having the yarn break, and the splicer 71 is swung into its operative position 71' adjacent the yarn path of travel between the delivery rolls 27 and 28, and the guide rod 34, note FIG. 4. Following this operation, the finished yarn end D extending from the take-up package 35 is withdrawn and threaded around the guide rod 34, and through the slot 73 of the splicer 71. The withdrawn yarn continues in the direction f between the delivery rolls 27 and 28', and is threaded through the hollow spindle 18 by means of a threading wire. The withdrawn end D is then held momentarily by the operator at a point immediately above the spindle 18.

Figure 6:
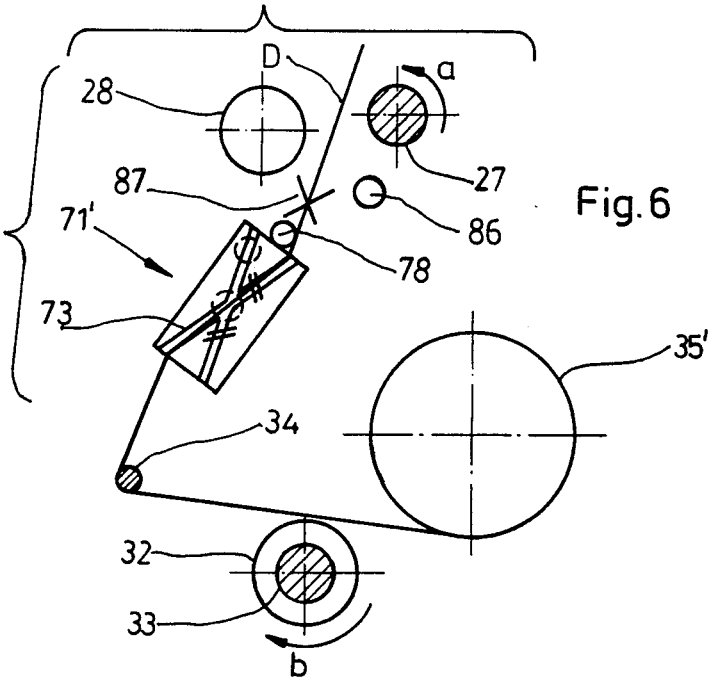
Figure 7:
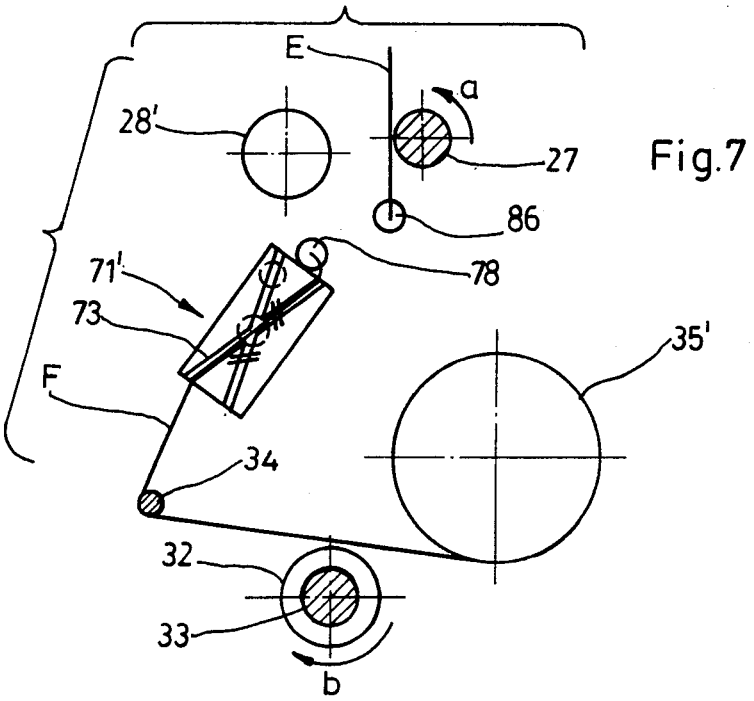
Figure 8:
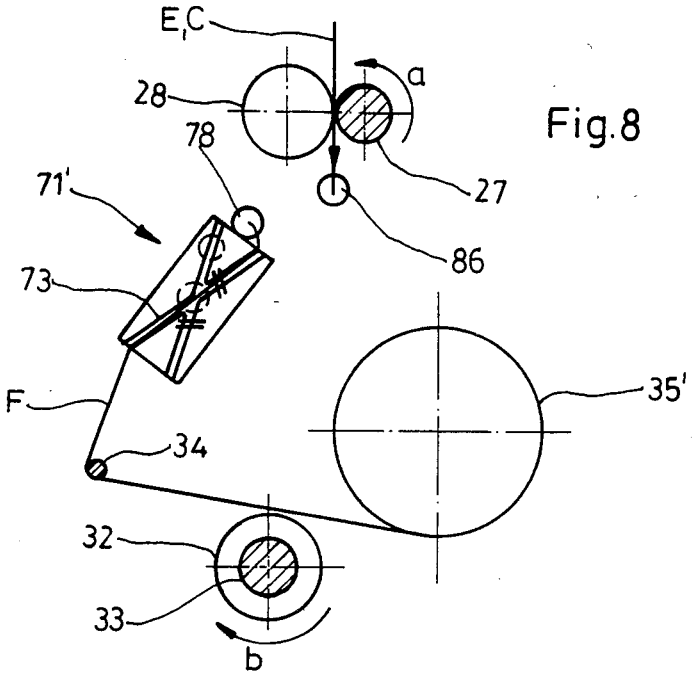

Preferably before starting the advance of the yarn sliver A and the spinning process, i.e. before the actual piecing up, the yarn D is severed at a point just below the delivery rolls 27 and 28' by a manual cutting device 87 as seen in FIG. 6. Thus an upstream yarn portion E is formed, as well as a separate downstream yarn portion F which remains threaded through the splicer 71, note FIG. 7. The end of the yarn portion F extending from the take-up package is then drawn into the suction accumulator 78 of the splicer 71' and is thereby retained. The end of the upstream yarn portion E leading through the spindle 18 is received in the suction accumulator 86, which is located immediately downstream of the rolls 27 and 28' as seen in FIG. 7. Preferably, the suction accumulator 86 comprises an elongate flexible suction hose which is releasably mounted to the frame of the machine, and with the free open end thereof being movable by the operator. Also, it is preferable that the suction hose have a sufficient length to permit a single hose to service a plurality of yarn winding stations.

To effect piecing up, the individual drives are returned to the operating position illustrated in FIG. 1 by the piston cylinder 39. However, it will be noted that the bobbin frame 37 is not actuated, so that the package 35' remains lifted from the drive roll 32. If desired, an additional device may be provided for this purpose, such as for example a pivoting holder supporting the bobbin frame 37 and mounted on the service carriage 68. A wedge can also be provided for this purpose. With the drafting system 1 thus being operative, the end of the originally withdrawn finished yarn which is immediately above the spindle 18 is manually inserted by the machine operator between the rolls 7 and 10, so that the drafted sliver A is drawn through the spindle 18 and wrapped with the binder strand B. As will be apparent, the pieced-up segment formed by this procedure will comprise a length of each of the finished yarn, the yarn sliver A, and the wrapped strand B. As a result, this pieced-up segment will be of undue size, and will thus constitute an initial low quality interconnection.

The newly spun pieced-up yarn C will continue to advance into the accumulator 86, and the low quality pieced-up segment will also advance into the accumulator 86. Thereafter, yarn C is inserted into the slot 72 of the splicer 71' in such a manner that it will travel through the slot 72 of the splicer 71', as it continues to be advanced into the extractor 86. For this purpose, and as best seen in FIG. 9, the extractor 86 is moved relative to the splicer 71 into a position 86'. Such movement may be manually conducted in a simple manner where the extractor 86 comprises a suction hose as described above. Also, it is preferable that a suitable releasable mounting arrangement for the hose be located on the machine at the location downstream of the splicer 71' as seen in FIG. 9.

At the moment of the actual splicing operation by the splicer 71' and as indicated in FIG. 10, the newly spun yarn C leading from the twisting spindle assembly 2 is momentarily held in the splicer 71' by the suction device 75, or by a suitable mechanical clamp (not shown) whereby the continuously advancing yarn C is drawn as a yarn loop 88 into the auxiliary accumulator 78. At this time, the cutting devices 76 and 77 are also operated so that the excess yarn pieces G and H are drawn into the suction accumulators 78 and 86', it being understood that the yarn received in the extractor 86' will include the initial low quality pieced-up segment. After the actual splicing operation, which includes actuation of the air nozzle 74, the take-up package at 35' is lowered into its operating position at 35 in contact with the grooved roll 32. Since the take-up speed of the winder is somewhat higher than the drawing speed, the small yarn loop 88 formed in the auxiliary extractor 78 is quickly removed, note FIG. 12. In this process, the yarn is also withdrawn from the splicer 71'. This withdrawal may, for example, be effected by moving the splicer 71' in a direction out of the yarn path of travel, or by initially positioning the splicer 71' at a distance from the yarn path so that there is a slight deflection when the yarn is placed in the slots 72 and 73.

Figure 13:
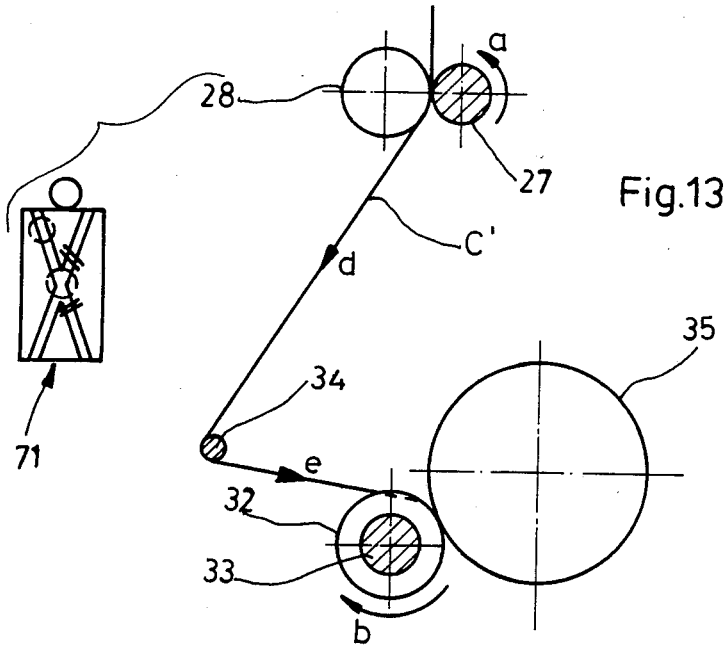

After the yarn loop 88 has been completely removed, the splicer 71 is returned to its rest position as seen in FIG. 13, so that the normal operating condition is restored. The splicer 71 can then be moved to another spinning station or to a rest position by means of the carriage 68, which can also transport the auxiliary extractor 86.

In the drawings and specification, there has been set forth a preferred embodiment of the invention, and although specific terms are employed, they are used in a generic or descriptive sense only and not for purposes of limitation.

That which is claimed is:

1. In a yarn spinning process wherein a fiber material is supplied to a spinning means and a spun yarn is advanced from said spinning means onto a rotating take-up package, a method for restarting the spinning of the yarn following a yarn break, and wherein the resulting finished yarn has a high quality interconnection, and comprising the steps of terminating the supply of said fiber material and the rotation of the take-up package, withdrawing the finished yarn end extending from the take-up package and threading the same through a yarn interconnecting means, and returning the same to said spinning means, piecing-up the withdrawn finished yarn end by restarting the supply of said fiber material and forming a piece-up segment, to produce a newly spun yarn which contains the pieced-up segment, severing the withdrawn finished yarn at a location between the yarn interconnecting means and said spinning means either prior to or immediately after the above piecing-up step, and so that the newly spun yarn which contains the pieced-up segment defines a severed leading end, advancing the newly spun yarn while accumulating the same in a first yarn accumulator, and so that the severed leading end and the pieced-up segment are received in the first yarn accumulator without forming a loop, threading the newly spun yarn through the yarn interconnecting means and while continuing to advance the newly spun yarn and accumulate the same in said first yarn accumulator, then momentarily holding the newly spun yarn in the yarn interconnecting means and actuating the yarn interconnecting means to interconnect the same with the withdrawn finished yarn previously threaded through the yarn interconnecting means and to thereby form a high quality interconnection, while continuing to advance the newly spun yarn and while accumulating the same in a second separate auxiliary yarn accumulator disposed upstream of the yarn interconnecting means, and severing the yarn disposed in the first yarn accumulator and which includes the severed leading end and the pieced-up segment, and then winding the resulting finished yarn upon the take-up package, and so as to withdraw the yarn accumulated in said auxiliary accumulator, whereby the pieced-up segment is removed and replaced with a high quality yarn interconnection without interruption of the advance of the newly spun yarn.

2. The method as defined in claim 1 wherein said first yarn accumulator comprises a movable suction tube, and wherein the step of threading the upstream yarn portion through the yarn interconnecting means includes moving the suction tube to a location downstream of the yarn interconnecting means.

3. The method as defined in claim 2 wherein the step of actuating the yarn interconnecting means includes contacting both the newly spun yarn and the withdrawn finished yarn with a pressurized airstream to form a splice therebetween.

4. The method as defined in claim 3 comprising the further step of severing any excess end portion of the withdrawn finished yarn concurrently with the step of severing the yarn disposed in the first yarn accumulator, and withdrawing such severed excess end portion into said auxiliary accumulator.

5. The method as defined in claim 1 wherein the yarn interconnecting means is mounted on a carriage which is movable along the yarn spinning machine, and wherein the method includes the step of moving the carriage to a position in alignment with the normal path of travel of the yarn prior to threading the yarn end extending from the take-up package through the yarn interconnecting means.

6. The method as defined in claim 5 wherein the yarn interconnecting means is movably mounted with respect to said carriage, and wherein the method includes the step of moving the yarn interconnecting means to an operative position closely adjacent the normal path of travel of the yarn prior to threading the yarn end extending from the take-up package through said yarn interconnecting means.

7. A yarn spinning apparatus wherein a yarn is delivered from a yarn supply and wound onto a take-up package, and which is characterized by the ability to interconnect broken yarn ends after a yarn break with a high quality interconnection, said apparatus comprising a frame mounting a plurality of side by side spinning units, with each spinning unit including fiber supply means for advancing a yarn along a path of travel, and yarn winding means for winding the advancing yarn onto a take-up package, control means for selectively operating both said fiber supply means and said yarn winding means, or only said fiber supply means, a carriage mounted for movement along at least one side of the apparatus and to a position immediately adjacent each of said spinning units, said carriage including yarn splicing means for splicing together two separate yarn segments which are threaded therethrough, means for severing the yarn of each of said spinning units when said carriage is disposed adjacent each such unit, and at a location between the yarn splicing means and said fiber supply means, first yarn accumulator means associated with each of said spinning units and comprising an elongate suction tube mounted to said frame, with said suction tube having a free open end which is movable between two locations on opposite sides of the yarn splicing means when said carriage is disposed adjacent the associated spinning unit, and such that said first yarn accumulator means is adapted to thread a severed yarn end through said yarn splicing means while the severed yarn is being advanced and accumulated therein without forming a loop, and second yarn accumulator means comprising a second suction tube mounted to said carriage and having an open end fixedly mounted with respect to said yarn splicing means, with said second yarn accumulator means being adapted to accumulate a portion of the advancing yarn during actuation of said yarn splicing means.

8. The yarn spinning apparatus as defined in claim 7 wherein said first yarn accumulator means comprises an elongate flexible tube which is adapted to be manually moved between said two locations on opposite sides of said yarn splicing means.

9. The yarn spinning apparatus as defined in claim 7 wherein said yarn splicing means is movably mounted on said carriage between an operating position closely adjacent the normal path of travel of the yarn and a laterally withdrawn non-operative position.

10. The yarn spinning apparatus as defined in claim 9 wherein said splicing means comprises means for directing a pressurized airstream against the two separate yarn segments which are threaded therethrough to form a splice therebetween.

11. The yarn spinning apparatus as defined in claim 10 wherein said splicing means further comprises means for severing the excess end portions of the two separate yarn segments which are threaded therethrough, and so that the excess end portions may be removed through said first and second yarn accumulator means respectively.

12. A yarn spinning apparatus adapted to form a wrapped yarn composed of a core strand having a binder strand spirally wrapped thereabout, and comprising a frame mounting a plurality of side by side spinning units, with each spinning unit including (a) a spindle assembly including a hollow spindle rotatably mounted to said frame, with said spindle being adapted to coaxially mount a supply package of the binder strand and so that the supply package rotates with the hollow spindle, (b) fiber material feed means mounted to said frame for advancing the core strand through the hollow spindle, (c) yarn take-up means mounted to said frame downstream of said spindle for winding an advancing yarn onto a yarn take-up package, (d) drive means for rotating said hollow spindle and operatively driving said fiber material feed means and said yarn take-up means, and such that the binder strand may be withdrawn from the rotating supply package and guided through the rotating hollow spindle so as to be spirally wrapped about the advancing core strand to form a wrapped yarn which is then wound onto the yarn take-up package, and (e) control means for selectively rotating said hollow spindle and operatively driving said fiber material feed means while said yarn take-up means is disengaged, a carriage mounted for movement along at least one side of the apparatus and to a position immediately adjacent each of said spinning units, said carriage mounting yarn splicing means for splicing together two separate yarn segments which are threaded therethrough, said yarn splicing means being mounted for movement on said carriage between an operative position closely adjacent the yarn path of travel at the adjacent spinning unit, and a withdrawn inoperative position, means for severing the yarn of each of said spinning units when said carriage is disposed adjacent each such unit, and at a location between said yarn splicing means and said spindle assembly, first yarn accumulator means associated with each of said spinning units and comprising an elongate suction tube mounted to said frame, with said suction tube having a free open end which is movable between two locations on opposite sides of the yarn splicing means when said carriage is disposed adjacent the associated spinning unit, and such that said first yarn accumulator means is adapted to thread a severed yarn end through said yarn splicing means while the severed yarn is being advanced and accumulated therein without forming a loop, and second yarn accumulator means comprising a second suction tube mounted to said carriage and having an open end fixedly mounted to said yarn splicing means, with said second yarn accumulator means being adapted to accumulate a portion of the advancing yarn during actuation of said yarn splicing means.

* * * * *